US006085376A

United States Patent [19]

Antal et al.

[11] Patent Number: 6,085,376

[45] Date of Patent: Jul. 11, 2000

[54] PIPE CLEANING APPARATUS

[75] Inventors: Michael P. Antal, Slippery Rock; Brian D. Antal, Beaver Falls, both of Pa.

[73] Assignee: ITC, Inc., Ellwood City, Pa.

[21] Appl. No.: 09/131,025

[22] Filed: Aug. 7, 1998

[51] Int. Cl.[7] ..... B08B 9/04

[52] U.S. Cl. ..... 15/104.061; 15/104.16

[58] Field of Search ..... 15/104.16, 104.061, 15/104.068, 104.05, 3.5; 29/456

[56] References Cited

U.S. PATENT DOCUMENTS

| | | | |
|---|---|---|---|
| 51,362 | 12/1865 | Spiegle | 15/104.061 |
| 2,215,514 | 9/1940 | MacGregor | 15/104.061 |
| 2,734,208 | 2/1956 | Griffin | 15/104.061 |
| 3,473,961 | 10/1969 | Heeren et al. . | |
| 3,939,519 | 2/1976 | Muirhead . | |
| 3,946,455 | 3/1976 | Echols et al. . | |
| 4,069,535 | 1/1978 | Cato . | |
| 4,113,890 | 9/1978 | Long . | |
| 4,178,649 | 12/1979 | Kouse et al. | 15/104.061 |
| 4,281,432 | 8/1981 | Saxon . | |
| 4,416,703 | 11/1983 | Scott . | |
| 4,595,050 | 6/1986 | Baron . | |
| 4,606,403 | 8/1986 | Fujimoto et al. . | |
| 4,716,611 | 1/1988 | Barry . | |
| 4,720,884 | 1/1988 | Ralls . | |
| 4,760,868 | 8/1988 | Saxon . | |
| 4,937,907 | 7/1990 | Antal . | |
| 4,982,764 | 1/1991 | Saxon . | |
| 5,153,963 | 10/1992 | Saxon et al. . | |
| 5,305,488 | 4/1994 | Lyle | 15/104.16 |
| 5,528,790 | 6/1996 | Curran | 15/104.061 |
| 5,784,745 | 7/1998 | Saxon et al. | 15/104.061 |
| 5,940,922 | 8/1999 | Saxon et al. | 15/104.061 |

OTHER PUBLICATIONS

ITC, Inc., Industrial Tube Cleaning Brochure, 10 pp. month, year unknown.

*Primary Examiner*—Terrence R. Till
*Assistant Examiner*—Kaj K. Olsen
*Attorney, Agent, or Firm*—Webb Ziesenheim Logsdon Orkin & Hanson, P.C.

[57] ABSTRACT

A pipe cleaning apparatus that is a pipe cleaning plug assembly for cleaning pipes or tubes that includes a plurality of scrapers removably secured to a plurality of shafts. Each of the scrapers includes a body having an outer perimeter defining a scraper blade and at least one perforation defined by the body. Each of the shafts is removably secured to the scraper. The scraper blade is adapted to contact an inner surface of a tube or a pipe.

15 Claims, 2 Drawing Sheets

PIPE CLEANING APPARATUS

BACKGROUND OF THE INVENTION

1) Field of the Invention

The present invention relates generally to the field of pipe cleaning apparatus and, more particularly, to plug assemblies used to clean heat exchanger and condenser tubing or piping.

2) Description of the Prior Art

Many heat exchangers utilize water passing through tubes. Water sources passing through the tubes present many problems, such as deposits and obstructions, that limit the heat transfer and life expectancy of the tubing. Slime, sticks, mud, shells, calcium carbonate scale or manganese scale are examples of problems.

Pipe cleaning assemblies have been developed to aid in the removal of the obstructions and deposits. Typically, these pipe cleaning assemblies include a fin or blade arrangement attached to a body. The pipe cleaning assembly is placed at one end of the tube to be cleaned with the fins in contact with an inner surface of the tube. High pressure water or other liquid is applied to the tube and passes the pipe cleaning assembly through the tube, scraping the inner surface and removing obstructions and deposits along the way until the pipe cleaning assembly exits the tube.

The pipe cleaning assemblies can be made from a polymeric material, such as the FLEX-DART™ pipe cleaning assembly manufactured by ITC, Inc., the assignee of this patent application. For more difficult deposits, a metal fin can be used, such as the stainless steel DART™ pipe cleaning assembly manufactured by ITC, Inc., the assignee of this patent application, and shown in FIG. 1.

Specifically, FIG. 1 shows a prior art stainless steel DART™ pipe cleaning assembly 10 that includes a unitary plastic body 12 having a plurality of stamped metal scraper blades 14 removably attached thereto. The metal scraper blades 14 include an engagement portion 16 and a scraping blade portion 18. Legs 20 connect the scraping blade portion 18 to the engagement portion 16. Windows 22 are defined by the legs 20. The scraping blade leg portion 18 is defined by three arcuate segments 24 of approximately 90° and results in a non-continuous member with a body receiving opening 26. Finally, a tip 28 and a tail piece 30 are provided on the body 12.

Preferably, three metal scraper blades 14 are received by the body 12. The metal scraper blades 14 are axially spaced apart from each other and circumferentially offset so that the pipe cleaning assembly 10 contacts the complete periphery of the inner surface of the pipe as it is pushed through the tube.

Although the pipe cleaning assembly 10 works well, it must be preassembled which requires a substantial amount of labor costs. Also, the length of the pipe cleaning assembly 10 is limited by the length of the body 12. Furthermore, the metal scraper blades 14 are expensive to manufacture because of their non-circular shape that results in a high rejection rate. Furthermore, the pipe cleaning assembly 10 cannot be repaired in the field.

Therefore, it is an object of the present invention to provide a pipe cleaning assembly that can be assembled and repaired in the field and is inexpensive to manufacture.

SUMMARY OF THE INVENTION

The present invention is a pipe cleaning assembly or a cleaning plug assembly for cleaning tubes or pipes that includes a scraper and a shaft removably secured to the scraper. The scraper includes a scraper body with an outer perimeter defining a scraper blade and at least one perforation defined by the body. The shaft includes a shaft body. The scraper blade is adapted to contact an inner surface of a tube. Preferably, the cleaning plug assembly for cleaning tubes includes a plurality of scrapers and a plurality of shafts, wherein a portion of each scraper is sandwiched between two adjacent shafts.

The present invention is also a method for manufacturing a cleaning plug assembly including the above-described scrapers and shafts and includes the steps of: (a) placing a scraper adjacent a shaft; (b) removably securing another shaft to the shaft and sandwiching a portion of the scraper between the shaft and the other shaft resorting in a portion of a cleaning plug assembly shaft; (c) placing another scraper adjacent the portion of the cleaning plug assembly; (d) removably securing to an adjacent shaft of the portion of the cleaning plug assembly another shaft sandwiching the portion of the second scraper between the other shaft and the adjacent shaft thereby forming a portion of the cleaning plug assembly; (e) continuing steps (c) and (d) until a cleaning plug assembly is formed made up of a plurality of scrapers removably secured to a plurality of shafts.

DESCRIPTION OF THE PREFERRED EMBODIMENT

Figure 1:
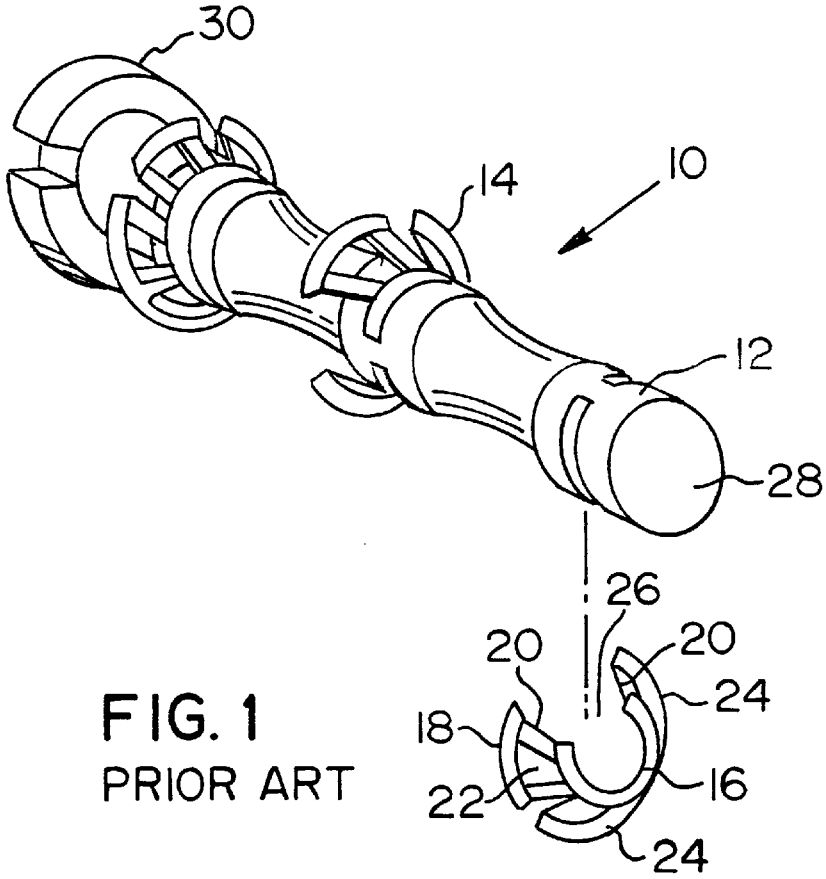
FIG. 1 PRIOR ART
FIG. 1 is a perspective view of a prior art pipe cleaning assembly.
Figure 2:
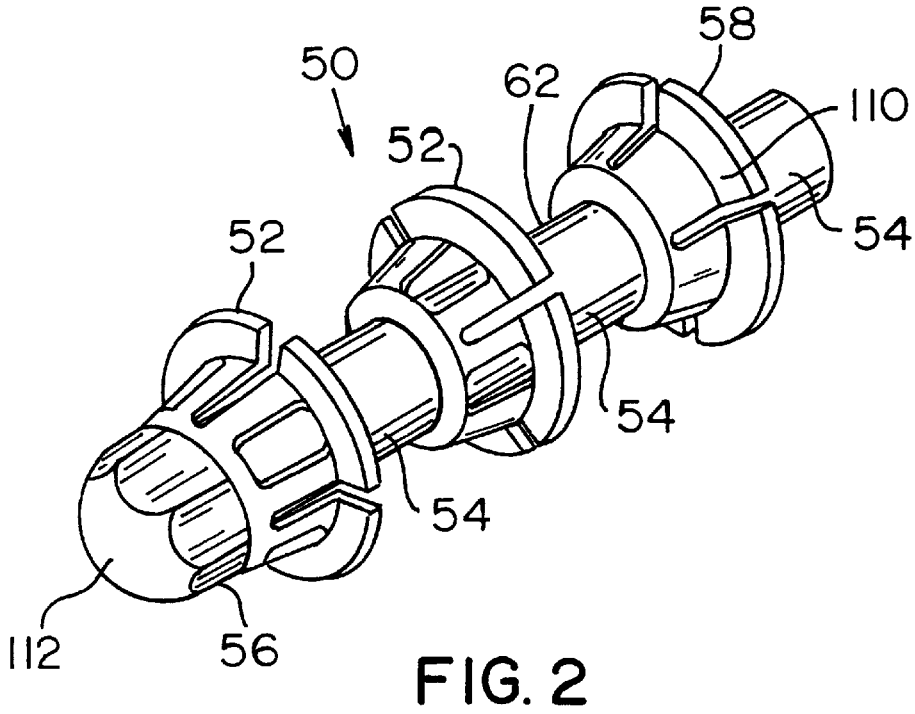
FIG. 2 is a perspective view of a pipe cleaning assembly made in accordance with the present invention.
Figure 3:
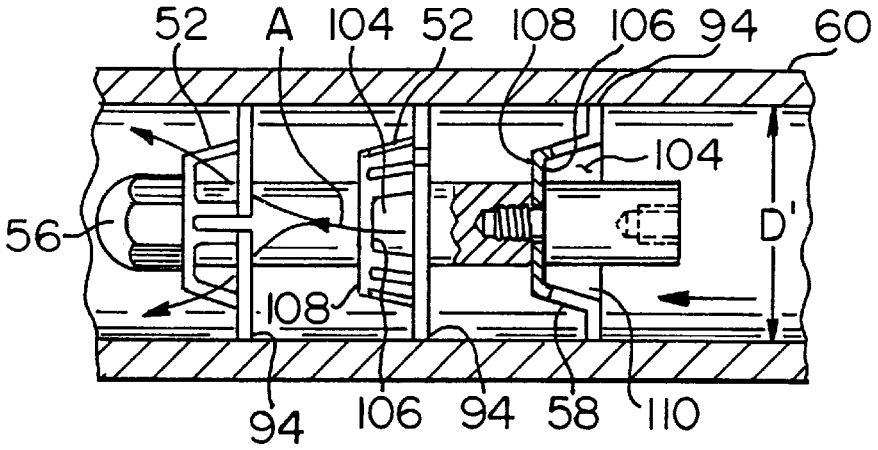
FIG. 3 is an elevational view, partially in section, of the pipe cleaning assembly shown in FIG. 2 received in a pipe.

FIG. 2 shows a cleaning plug assembly 50 for cleaning tubes made in accordance with the present invention. Alternatively, the cleaning plug assembly 50 can also be referred to as a pipe cleaning assembly or a pig. The cleaning plug assembly 50 includes a plurality of scrapers 52 removably connected to a plurality of shafts 54. A tip 56 is removably secured at a forward end of the cleaning plug assembly 50 and a rear end tail piece or scraper 58 is removably attached near a rear end of the cleaning plug assembly 50. As shown in FIG. 3, the cleaning plug assembly 50 is adapted to be received within a tube or pipe 60.

Figure 4:
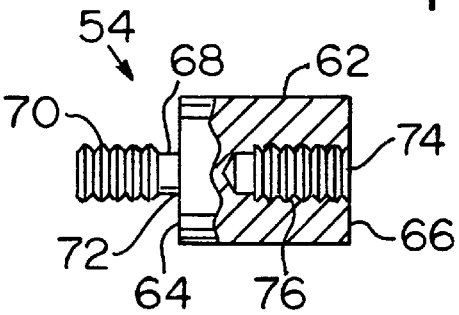
FIG. 4 is an elevational view, partially in section, of a shaft of the pipe cleaning assembly shown in FIG. 2.

Referring to FIG. 4, the shaft 54 includes a cylindrical shaft body 62 having a first end 64 and a second end 66. A cylindrically-shaped pin 68 extends from the first end 64. Threads 70 are defined on the pin 68. A shoulder 72 is defined at the second end 66 at the interface between the pin 68 and the shaft body 62. A closed ended pin receiving hole 74 defined by a threaded surface 76 is located at the second end 66 of the shaft body 62. The pin receiving hole 74 is adapted to removably receive a pin 68 of an adjacent body 12.

Figure 5:
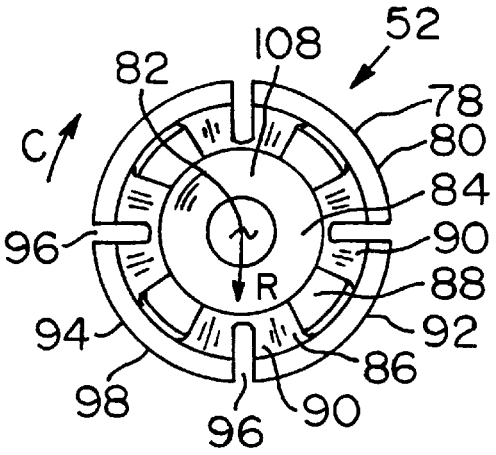
FIG. 5 is a top plan view of a scraper of the pipe cleaning assembly shown in FIG. 2.
Figure 6:
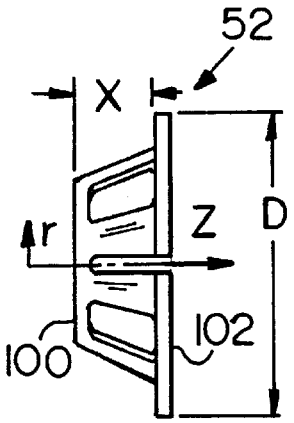
FIG. 6 is an elevational view of the scraper shown in FIG. 5.

FIGS. 5 and 6 show the scraper 52. The scraper 52 includes a scraper body 78 having a circumferentially-shaped scraper blade 80 positioned about a perimeter of the scraper body 78. A central hole 82 is defined by a continuous hole defining portion 84. A perforated portion 86 extends from the continuous hole defining portion 84 and defines a plurality of perforations or windows 88. The perforations or windows 88 are defined by axially extending legs 90. The perforated portion 86 is secured to a scraper blade portion 92, which defines the scraper blade 80. Specifically, each of the axially extending legs 90 is attached at one end to the continuous hole defining portion 84 and at another end to the scraper blade portion 92.

A plurality of scraper segments 94 make up the perforated portion 86 and the windows 88. Slots 96 are defined between adjacent scraper segments 94. As shown in FIG. 5, four circumferentially spaced scraper segments 94 are provided on the scraper 52. Each scraper segment 94 is spaced approximately 90° apart. Each scraper segment 94 is defined by two axially extending legs 90 and an arcuate shaped scraper blade 98. An outer surface of the continuous hole defining portion 84 is contained within a plane 100 and an outer surface of the scraper blade portion 92 is contained within a plane 102. Planes 100 and 102 are normal to a Z axis passing through the center of the central hole 82 and spaced apart a distance or offset X. The legs 90 extend in a radial direction r and in an axial direction Z which creates the offset X. An outer radius of the continuous hole defining portion 84 is R and an outer diameter of the scraper blade 80 is D, wherein 2×R is less than D. The slots 96 permit flexing of the scraper segments 94 in a radial direction toward the Z axis. Referring to FIG. 3, a recess 104 is defined by inner surfaces of the axially extending legs 90 and an inner surface 106 of the continuous hole defining portion 84. The continuous hole defining portion 84 also includes an outer surface 108.

The rear end scraper 58 is similar to the above-identified scraper 52 except for the following differences. The scraper segments 94 do not include perforations or windows 88, but include a solid depending leg or portion 110 as shown in FIG. 2. Arcuate shaped scraper blades 98 and the continuous hole defining portion 84 are secured to respective solid portions 110. Slots 96 are defined between adjacent scraper segments 94. The tip 56 is a closed ended nut having a rounded upper surface 112 and a threaded hole (not shown) positioned opposite the rounded upper surface 112 adapted to receive the threaded pin 68.

Preferably, the scrapers 52, shafts 54, tip 56 and rear end scraper 58 are made of metal. For example, the shafts 54 can be made of aluminum and the scrapers 52 can be stamped from sheet metal. However, many of these parts can be made of other materials, such as a polymeric material.

Assembly of the cleaning plug assembly 50 will not be discussed. Initially, a shaft 54 is received within the recess 104 so that the pin 68 passes through the central hole 82 and the shoulder 72 abuts the inner surface 106 of the scraper 52. A second shaft 54 is then threadably and removably attached to the pin 68 until the second end 66 abuts the outer surface 108 of the scraper 52. In this manner, a portion of the continuous hole defining portion 84 is sandwiched between the shaft bodies 62 of two adjacent shafts 54 as shown in FIG. 3. This arrangement defines a portion of the cleaning plug assembly 50. This procedure can then be repeated until a requisite number of scrapers 52 are removably attached to shafts 54 as shown in FIG. 3. Any number of scrapers 52 can be provided, for example, two, three or more. At the forward end of the cleaning plug assembly 50, a pin 68 will extend from the forward most scraper 52. The tip 56 is threadably received by the pin 68 and removably secures the forward most scraper 52 to the shaft 54. Essentially, the tip 56 is a shaft body 62 without the pin 68 which is replaced by the rounded upper surface 112. The rearward most scraper is the rear end scraper 58 which is removably secured between two adjacent shafts 54.

Preferably, the scraper blade 80 has the outer diameter D which is greater than the inner diameter D' of the tube 60. For example, the differences between the two diameters should be on the order of several thousands of an inch. In this manner, when the cleaning plug assembly 50 is inserted into the tube 60, the scraper segments 94 will flex toward the Z axis and be in contact with an inner surface of the tube 60 with a scraping force applied thereto.

In operation, the assembled cleaning plug assembly 50 is inserted in the tube 60 with the tip 56 preceding the rear end scraper 58. High pressure fluid, such as water, is supplied to the tube 60 rearwardly of the rear end scraper 58. The fluid pressure forces the cleaning plug assembly 50 to move through the tube 60 toward an exit end with a portion of cleaning fluid passing through the slots 96 of the rear end scraper 58 and the slots 96 and perforations 88 of the other scrapers 52 and represented by arrows A. The scrapers 52 scrape deposits from the inner surface of the tube 60 which are then pushed along by the scrapers 52 or are carried by the water passing through the slots 96 and perforations 88 as shown in FIG. 3. After the cleaning plug assembly 50 exits the tube 60, the process can be repeated on another tube 60.

The cleaning plug assembly 50 can be assembled prior to use or assembled onsite, as needed. Further, the present invention permits repair of the cleaning plug assemblies 50 onsite by replacing any damaged scrapers 52 and/or shafts 54. Also, a number of scrapers 52 of the cleaning plug assembly 50 can be modified onsite. Specifically, if it is determined that three scrapers 52 do not adequately clean the tube 60, then additional scrapers 52 can be added to the cleaning plug assembly 50.

The present invention also minimizes waste. In the prior art, the cleaning plug assemblies were discarded once the scrapers wore. In the present invention, only the worn scrapers 52 need to be discarded.

Further, the present invention is much easier to assemble than the previously described prior art since the orientations of the scrapers 52, relative to the shafts 54, are not important as is the case in the prior art. Also, since the scrapers 52 include a continuous hole defining portion 84, it is easier to manufacture and maintain tolerances than the previously described non-continuous arrangement. This minimizes the rejection rate of the scrapers 52 and the scrapers 52 are easier to manufacture than the prior art.

Having described the presently preferred embodiment of the invention, it is to be understood that it may otherwise be embodied within the scope of the appended claims.

What is claimed is:

1. A cleaning plug assembly for cleaning tubes, comprising:

(a) a scraper having a scraper body with an outer perimeter defining a scraper blade and at least one perforation defined by said body, said scraper defining a scraper pin receiving hole;

(b) a shaft removably secured to said scraper, said shaft comprising a shaft body, said shaft body including a first end and a second end; wherein a pin extends from said first end and a pin receiving hole is defined at said second end of said shaft body, said pin passes through the scraper pin receiving hole, and wherein said shaft body defines a shoulder at an interface of said pin and said shaft body, said pin receiving hole of said shaft body is adapted to receive a pin of an adjacent shaft; and (c) a securement member removably secured to said pin whereby a portion of said scraper is sandwiched between said shaft body and said securement member, wherein said scraper blade is adapted to contact an inner surface of a tube.

2. A cleaning plug assembly as claimed in claim 1, wherein said pin includes a threaded surface that is threadably received by said securement member.

3. A cleaning plug assembly as claimed in claim 1, wherein said securement member is an adjacent shaft that includes a shaft body, a pin extending from a first end of said shaft body and a pin receiving hole defined at a second end of said shaft body, wherein said pin of said shaft is received within the pin receiving hole of said adjacent shaft body, a portion of said scraper body is sandwiched between said shaft body and said adjacent shaft body.

4. A cleaning plug assembly as claimed in claim 3, wherein each of said shaft pins is threaded and each of the shaft bodies defines threaded pin receiving holes.

5. A cleaning plug assembly as claimed in claim 1, wherein the scraper pin receiving hole defined by a central hole defined by a central hole defining portion of said scraper body, a perforated portion defining a plurality of perforations of said body, said perforated portion extending from the central hole defining portion and adapted to permit a fluid to pass through the perforations and a scraper blade portion extending from said perforated portion defining said scraper blade.

6. A cleaning plug assembly as claimed in claim 5, wherein said central hole defining portion is continuous.

7. A cleaning plug assembly as claimed in claim 6, wherein a plurality of radially extending scraper segments defines said perforated portion of said body and said scraper blade portion, wherein radially extending slots are defined between adjacent segments.

8. A cleaning plug assembly as claimed in claim 7, wherein each of said scraper blade segments defines an arcuate shaped scraper blade.

9. A cleaning plug assembly as claimed in claim 8, wherein each of said segments is adapted to elastically flex toward a central axis passing through the central hole.

10. A cleaning plug assembly as claimed in claim 9, wherein said scraper is formed by stamped metal.

11. A cleaning plug assembly as claimed in claim 7, wherein said scraper blade segments are circumferentially spaced apart and define said scraper blade portion, said scraper blade portion is axially offset from said central hole defining portion.

12. A cleaning plug assembly as claimed in claim 11, wherein said perforated portion comprises a plurality of axially extending legs connecting said scraper blade portion to said central hole defining portion, wherein said perforations are defined between adjacent axial extending legs.

13. A cleaning plug assembly as claimed in claim 1, further comprising a plurality of scrapers and a plurality of shafts, wherein each of said scrapers includes a body with an outer perimeter defining a scraper blade and at least one perforation and each of said shafts includes a shaft body and wherein adjacent ones of said shaft bodies sandwich a portion of a respective one of said scrapers.

14. A cleaning plug assembly as claimed in claim 13, further comprising a forward tip secured to a forward most positioned shaft and an end scraper coacting with a rearward most shaft.

15. A cleaning plug assembly for cleaning tubes, comprising:

(a) a scraper having a scraper body with an outer perimeter defining a scraper blade and at least one perforation defined by said body, wherein said scraper body defines a central hole defined by a continuous central hole defining portion of said body, a perforated portion defining a plurality of perforations of said body extending from said central hole defining portion adapted to permit water to pass through the perforations and a scraper blade portion extending from said perforated portion defining said scraper blade, said perforated portion comprises a plurality of axially extending legs connected to said scraper blade portion and said central hole defining portion, wherein said perforations are defined between adjacent legs, said perforated portion of said scraper body and said scraper blade portion defined by a plurality of radially extending scraper segments, wherein radially extending slots are defined between adjacent segments and each of said segments defines an arcuate shaped scraper blade, said segments are circumferentially spaced apart and axially offset from said central hole defining portion and said segments are adapted to elastically flex in toward a central axially extending axis passing through the central hole;

(b) a shaft removably secured to said scraper, said shaft comprising a shaft body, wherein said shaft includes a threaded pin that extends from said shaft body and passes through the central hole, said shaft body has a first end and second end and defines a shoulder at an interface of said pin and said shaft body, said pin extending from said first end and a threaded pin receiving hole is defined at said second end, said threaded pin receiving hole is adapted to receive a pin of an adjacent shaft; and (c) an adjacent shaft that includes a shaft body, a threaded pin extending from a first end of said shaft body and a threaded pin receiving hole defined at a second end of said shaft body, wherein said threaded pin of said shaft is received within the threaded pin receiving hole of said adjacent shaft body whereby a portion of said scraper body is sandwiched between said shaft body and said adjacent shaft body, wherein said scraper blade is adapted to contact an inner surface of a tube.

* * * * *